US009714164B2

(12) United States Patent
Walton et al.

(10) Patent No.: US 9,714,164 B2
(45) Date of Patent: Jul. 25, 2017

(54) APPARATUS FOR STORING AND DISPENSING LIQUID FROM A LIQUID RETAINING BAG

(71) Applicant: Cardomon International Limited, Tsimhatsui, Kowlon (HK)

(72) Inventors: Philip A. Walton, Bishop Auckland (GB); Frederick M. Partington, Edmonton (CA)

(73) Assignee: Cardomon International Limited, Hong Kong (HK)

( * ) Notice: Subject to any disclaimer, the term of this patent is extended or adjusted under 35 U.S.C. 154(b) by 0 days.

(21) Appl. No.: 14/714,456

(22) Filed: May 18, 2015

(65) Prior Publication Data

US 2016/0340168 A1 Nov. 24, 2016

(51) Int. Cl.
*B67D 1/00* (2006.01)
*B67D 1/08* (2006.01)

(52) U.S. Cl.
CPC ..... *B67D 1/0809* (2013.01); *B67D 1/0004* (2013.01); *B67D 1/0802* (2013.01); *B67D 1/0857* (2013.01); *B67D 2001/0827* (2013.01)

(58) Field of Classification Search
CPC .. B67D 1/0809; B67D 1/0004; B67D 1/0857; B67D 2001/0827
(Continued)

(56) References Cited

U.S. PATENT DOCUMENTS 4,058,121 A 11/1977 Choksi
4,265,372 A 5/1981 Wainberg
(Continued)

FOREIGN PATENT DOCUMENTS

DE 1293052 4/1969
EP 0141433 5/1985
(Continued)

OTHER PUBLICATIONS

International Search Report and Written Opinion, Jun. 30, 2016 issued in International Application No. PCT/IB2016/052481, 8 pages.

*Primary Examiner* — Patrick M Buechner
*Assistant Examiner* — Jeremy W Carroll
(74) *Attorney, Agent, or Firm* — Merek, Blackmon & Voorhees, LLC

(57) ABSTRACT

An apparatus configured to store and dispense liquid from a liquid retaining bag. The apparatus preferably includes a storage container for storing the liquid retaining bag. The liquid storage container and the liquid retaining bag are preferably housed in the bottom of a water cooler. The storage container includes a base, an upper opening and at least one wall extending upwardly from the base and defining a hollow cavity. The hollow cavity is sized to receive a liquid retaining bag. The apparatus further includes a liquid transport conduit for transporting liquid from the liquid retaining bag to a dispensing location. A guide and retaining member is operably associated with the storage container. The guide and retaining member is preferably configured to guide the liquid transport conduit from a first location to a second location. The second location is an operating position in which at least a portion of the liquid transport conduit extends into the liquid retaining bag and the first location is a location where no portion of the liquid transport conduit is within the liquid retaining bag. Preferably, the guide member and the storage container are configured such that the liquid transport conduit can be positioned in a third location where the liquid retaining bag can be removed from the storage container while at least a portion of the liquid transport conduit is connected to and held in place by the guide and retaining member. The third location is preferably between the first location and the second location.

20 Claims, 4 Drawing Sheets

(58) Field of Classification Search
USPC ..... 222/81, 105, 386.5, 95; 220/495.06, 220/495.1; 206/277; 229/117.35
See application file for complete search history.

(56) References Cited

U.S. PATENT DOCUMENTS

| | | | | |
|---|---|---|---|---|
| 4,484,697 | A * | 11/1984 | Fry, Jr. | B67D 1/0007 222/1 |
| 4,527,716 | A | 7/1985 | Haas | |
| 4,997,429 | A | 3/1991 | Dickerhoff | |
| 5,392,968 | A | 2/1995 | Dark | |
| 5,553,748 | A * | 9/1996 | Battle | B05B 11/0043 222/105 |
| 5,881,692 | A | 3/1999 | Lassanske | |
| 5,975,359 | A * | 11/1999 | Van Marcke | A47K 5/12 222/107 |
| 6,098,844 | A | 8/2000 | Nicolle | |
| 6,139,534 | A | 10/2000 | Niedospial | |
| 6,161,728 | A | 12/2000 | Dark | |
| 6,269,976 | B1 | 8/2001 | DeJonge | |
| 6,398,073 | B1 | 6/2002 | Nicolle | |
| 6,832,994 | B2 | 12/2004 | Niedospial | |
| 7,165,700 | B2 | 1/2007 | Macler | |
| 7,168,599 | B1 * | 1/2007 | Criswell | B62B 1/264 222/142.3 |
| 7,188,749 | B2 | 3/2007 | Miller | |
| 7,331,487 | B2 | 2/2008 | Macler | |
| 7,762,429 | B2 | 7/2010 | Macler | |
| 8,177,096 | B2 | 5/2012 | Macler | |
| 8,464,906 | B2 | 6/2013 | Macler | |
| 8,672,155 | B2 | 3/2014 | Knierbein | |
| 8,770,441 | B2 | 7/2014 | Macler | |
| 8,887,955 | B2 | 11/2014 | Walton | |
| 9,101,936 | B2 * | 8/2015 | Marcher | B01L 3/505 |
| 9,527,639 | B2 | 12/2016 | Walton | |
| 2005/0121464 | A1 * | 6/2005 | Miller | B65D 11/18 222/81 |
| 2006/0032864 | A1 * | 2/2006 | Jung | B67D 1/0809 222/83 |
| 2007/0032775 | A1 | 2/2007 | Niedospial | |
| 2013/0048681 | A1 * | 2/2013 | Walton | B67D 1/0009 222/333 |
| 2013/0053815 | A1 | 2/2013 | Mucientes | |
| 2015/0284235 | A1 * | 10/2015 | Blackburn | B67D 7/0255 222/1 |

FOREIGN PATENT DOCUMENTS

| | | |
|---|---|---|
| EP | 2017195 | 1/2009 |
| GB | 2046226 | 11/1980 |
| GE | 390369 | 10/1921 |
| WO | WO87/05208 | 9/1987 |
| WO | WO92/19528 | 11/1992 |
| WO | WO2007/081208 | 7/2007 |
| WO | WO 2014/110242 | 7/2014 |

* cited by examiner

FIG. 4
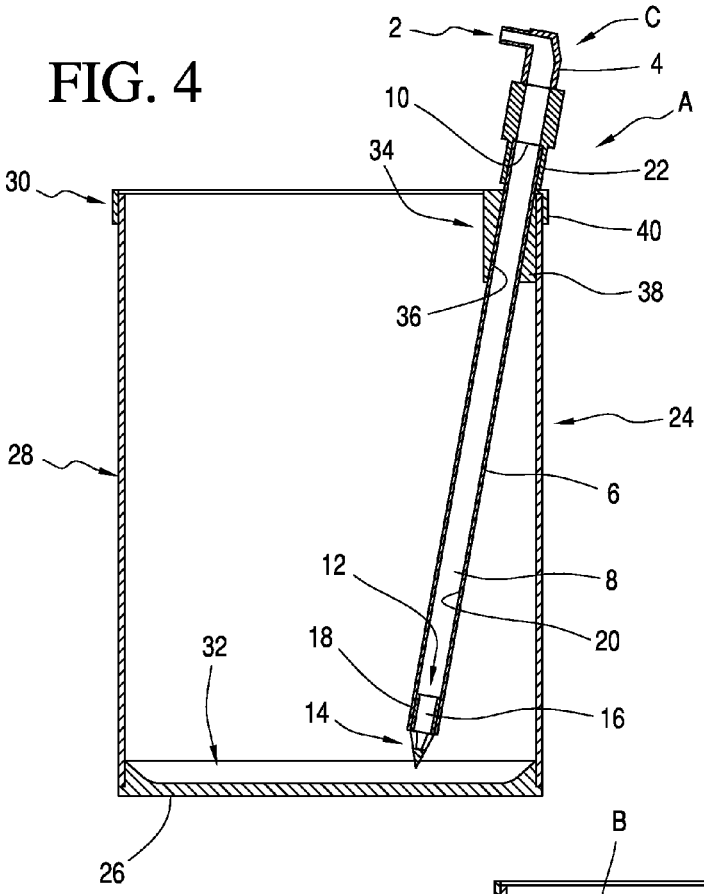
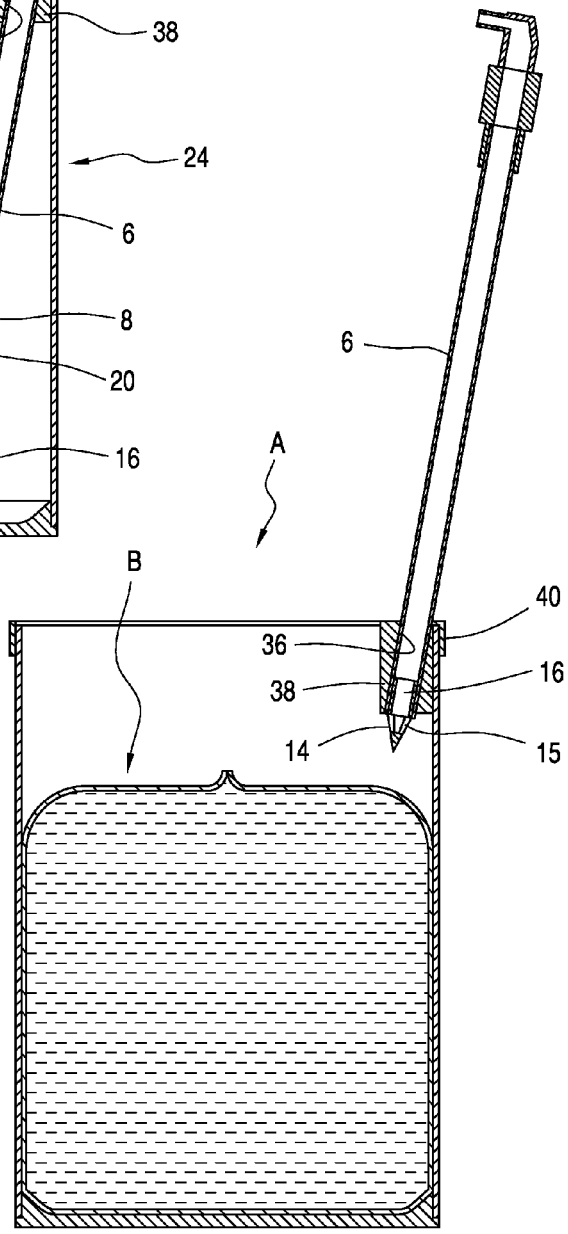
FIG. 5

APPARATUS FOR STORING AND DISPENSING LIQUID FROM A LIQUID RETAINING BAG

FIELD OF THE INVENTION

The present invention is directed to an apparatus for storing and dispensing liquid from a liquid retaining bag. In its most preferred form, the present invention is directed to an apparatus that dispenses liquid from a position above the liquid retaining bag, i.e., a bottom loaded dispensing apparatus (e.g., a bottom loaded water cooler).

BACKGROUND OF THE INVENTION

A significant number of existing water dispensers use gravity as the driving force to dispense water from the water dispenser. In this type of water dispenser, the water bottle is positioned above the dispensing location. These dispensers are referred to as "Top-Loading" water dispensers. Top-Loading water dispensers typically include means for receiving a five (5) gallon water bottle at the uppermost portion of the water dispenser. Five (5) gallon water bottles are quite heavy making it difficult for some individuals to mount the water bottle on the uppermost portion of the water cooler. To overcome the problem of mounting the heavy five (5) gallon water bottles on top of Top-Loading water dispensers, water dispensers in which the water bottle is stored in the lower portion of the water dispenser have been proposed. Since these systems cannot rely upon gravity to dispense drinking water, pumps are typically employed to pump the drinking water to the dispensing location located above the water bottle. These types of water dispensers are referred to herein as "Bottom-Loading" water dispensers.

As an alternative to the five (5) gallon water bottles, water coolers have been developed to use water retaining bags. There are several existing methods to puncture the water retaining bags in order to draw water from the water retaining bag. For example, an upstanding spike is located in such a manner that the water retaining bag is lowered onto the spike and the weight of the water retaining bag serves to cause the spike to puncture the water retaining bag. Systems of this type have an inherent disadvantage. Specifically, if a proper seal is not formed between the water retaining bag and the spike, water will leak. Some water coolers have a spike or other conduit that extends from above the water retaining bag. However, these water coolers do not allow for the water retaining bag to be readily removed and replaced with another water retaining bag.

OBJECTS AND SUMMARY OF THE INVENTION

An object of the present invention is to provide a novel and unobvious apparatus for storing and dispensing liquid from a liquid retaining bag.

Another object of a preferred embodiment of the present invention is to provide an apparatus for storing and dispensing liquid from a liquid retaining bag that is configured such that a liquid transport conduit while moving from a first location to an operating location is oriented at an acute angle to a vertical axis to facilitate puncturing of the liquid retaining bag.

Still another object of a preferred embodiment of the present invention is to provide an apparatus for storing and dispensing liquid from a liquid retaining bag that is configured such that a liquid transport conduit punctures the liquid retaining bag adjacent a sidewall of the liquid retaining bag and removed from a center portion of the liquid retaining bag.

A further object of a preferred embodiment of the present invention is to provide an apparatus for storing and dispensing liquid from a liquid retaining bag having a guide and retaining member that is operably associated with a storage container and guides a liquid transport conduit as it moves from a first location to an operating location where the first location is above the operating location.

Yet another object of a preferred embodiment of the present invention is to provide an apparatus for storing and dispensing liquid from a liquid retaining bag having a guide and retaining member that is operably associated with a storage container such that a liquid retaining bag can be readily removed and replaced with another liquid retaining bag while a liquid transport conduit is still retained by the guide and retaining member.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one preferred embodiment of the present invention is directed to an apparatus for storing and dispensing liquid from a liquid retaining bag having a storage container for storing a liquid retaining bag. The storage container includes a base, an upper opening and at least one wall extending upwardly from the base and defining a hollow cavity. The hollow cavity is sized to receive a liquid retaining bag. A liquid transport conduit is provided for transporting liquid from the liquid retaining bag to a dispensing location. A guide and retaining member is operably associated with the storage container. The guide and retaining member is configured to guide the liquid transport conduit from a first location to a second location, wherein the second location is an operating position in which at least a portion of the liquid transport conduit extends into the liquid retaining bag and the first location is a location where no portion of the liquid transport conduit is within the liquid retaining bag. The guide member and the storage container are configured such that the liquid transport conduit can be positioned in a third location where the liquid retaining bag can be removed from the storage container while at least a portion of the liquid transport conduit is connected to the guide and retaining member. The third location is between the first location and the second location.

Another preferred embodiment of the present invention is directed to an apparatus for storing and dispensing liquid from a liquid retaining bag having a storage container for storing a liquid retaining bag. The storage container includes a housing for housing a liquid retaining bag. A liquid transport conduit is provided for transporting liquid from the liquid retaining bag to a dispensing location. A guide and retaining member is operably associated with the storage container. The guide and retaining member is configured to guide the liquid transport conduit from a first location to a second location, wherein the second location is an operating position in which at least a portion of the liquid transport conduit extends into the liquid retaining bag and the first location is a location where no portion of the liquid transport conduit is within the liquid retaining bag, wherein in the second location the liquid transport conduit is oriented at an acute angle to a vertical axis passing through the liquid retaining bag.

A further preferred embodiment of the present invention is directed to an apparatus for storing and dispensing liquid from a liquid retaining bag having a storage container for storing a liquid retaining bag. The storage container includes a housing for housing a liquid retaining bag. A liquid transport conduit is provided for transporting liquid from the liquid retaining bag to a dispensing location. A guide and retaining member is operably associated with the storage container. The guide and retaining member is configured to guide the liquid transport conduit from a first location to a second location, wherein the second location is an operating position in which at least a portion of the liquid transport conduit extends into the liquid retaining bag and the first location is a location where no portion of the liquid transport conduit is within the liquid retaining bag. The guide and retaining member guides the liquid transport conduit to enter the liquid retaining bag adjacent a side wall portion of the liquid retaining bag. The side wall portion of the liquid retaining bag is offset from a center portion of the liquid retaining bag.

BRIEF DESCRIPTION OF THE DRAWINGS

FIG. 4 is a cross-sectional view taken along lines 4-4 in FIG. 3.

FIG. 5 is a cross-sectional view of the apparatus for storing and dispensing liquid from a liquid retaining bag depicted in FIG. 1 with the liquid retaining bag stored in the storage container and the liquid transport conduit located in a position above the liquid retaining bag.

DETAILED DESCRIPTION OF THE PREFERRED EMBODIMENTS OF THE INVENTION

The preferred forms of the invention will now be described with reference to FIGS. 1-7. The appended claims are not limited to the preferred forms and no term and/or phrase used herein is to be given a meaning other than its ordinary meaning unless it is expressly stated otherwise.

FIGS. 1 through 7

Figure 6:
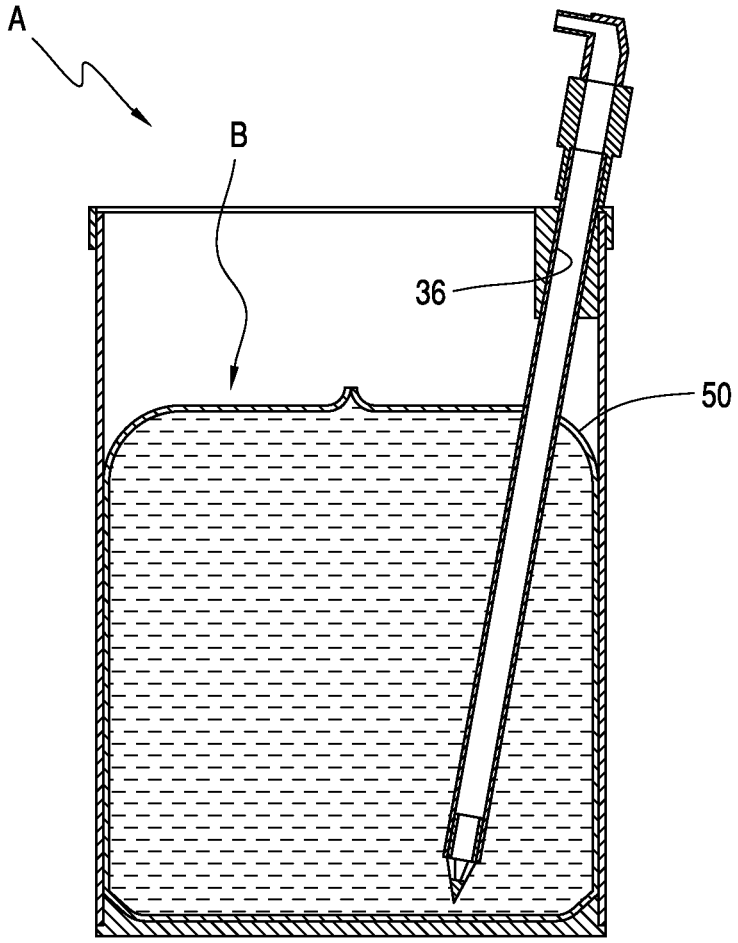
FIG. 6 is a cross-sectional view of the apparatus for storing and dispensing liquid from a liquid retaining bag depicted in FIG. 1 with the liquid retaining bag stored in the storage container and the liquid transport conduit located in one of several operating positions.

Referring to FIGS. 1 to 7, a preferred form of storage and liquid dispensing unit A is illustrated in one of many possible configurations. As illustrated in FIGS. 5 and 6, storage and liquid dispensing unit A stores and dispenses liquid from a liquid retaining bag B. Liquid retaining bag B is preferably formed from a collapsible material such that as liquid is dispensed from liquid retaining bag B, the bag B collapses. Preferably, the liquid retained by bag B is water. However, any suitable liquid may retained by liquid retaining bag B. Storage and liquid dispensing unit A is preferably used with a bottom loaded water cooler. For example, storage and liquid dispensing unit A housing liquid retaining bag B may be used with the bottom loaded water cooler disclosed in U.S. Pat. No. 8,887,955. The entire contents of U.S. Pat. No. 8,887,955 are incorporated herein by reference. By way of example and without limitation, storage and liquid dispensing unit A housing liquid retaining bag B may be positioned where water bottle E is disposed in FIG. 2 of U.S. Pat. No. 8,887,955. A shell of a bottom loaded water cooler may conceal storage and liquid dispensing unit A housing liquid retaining bag B. The shell may include a removable portion that allows one to readily gain access to storage and liquid dispensing unit A and liquid retaining bag B Storage and liquid dispensing unit A includes a liquid transport assembly C. End 2 of connector 4 of liquid transport assembly C can be connected to the lower end 40 of riser tube 34 of the liquid dispenser disclosed in U.S. Pat. No. 8,887,955. Liquid can be dispensed from bag B in the same manner that liquid is dispensed from bottle E of U.S. Pat. No. 8,887,955.

Figure 7:
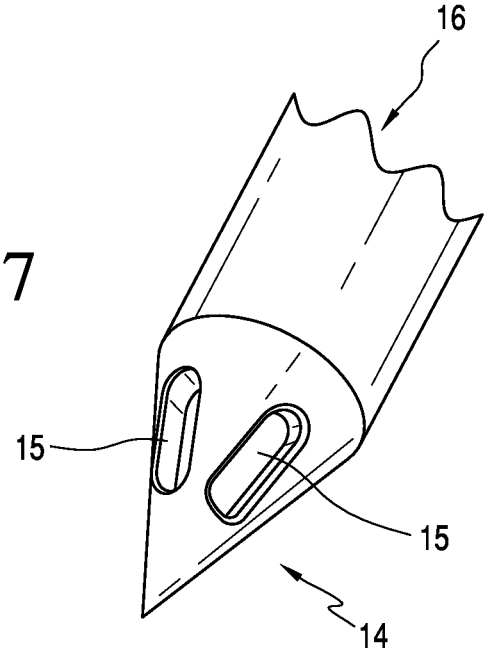
FIG. 7 is a fragmentary perspective view of the spiked end of the liquid transport conduit.

Liquid transport assembly C further includes a dip tube 6 preferably having a single hollow cavity 8 extending from an upper open end 10 and a lower open end 12. A spike 14 having a hollow internal cavity 16 extends into lower open end 12. Referring to FIG. 7, spike 14 includes one or more openings 15. The openings 15 can be uniformly spaced around the circumference of the tip of spike 14. The number and spacing of openings 15 can be readily varied as desired. Preferably, spike 14 is fixed to dip tube 6 such that liquid cannot pass between the outer cylindrical wall 18 of spike 14 and the internal cylindrical wall 20 of dip tube 6. Any suitable means can be used to fix spike 14 to dip tube 6. It should be noted that spike 14 and dip tube 6 can be formed as a single piece. Further, spike 14 can be configured such that it seats on and surrounds the lower end 12 of dip tube 6. Upper end of dip tube 6 extends into and is sealingly connected to lower end 22 of connector 4.

Storage and liquid dispensing unit A includes a storage container 24 having a base 26, a cylindrical wall 28 and a skirt 30. Skirt 30 surrounds and seats on the uppermost portion of wall 28. Skirt 30 can be fixed to wall 28 such that it cannot be removed from wall 28 by any suitable means including but not limited to glues, adhesives and/or fasteners. Alternatively, skirt 30 can be removably connected to wall 28 by any suitable means including but not limited to a force or friction fit. Further, skirt 30 and wall 28 can be formed as a single piece.

Base 26 is preferably sealingly connected to the lower portion of wall 28. This connection can be formed by any suitable means. Alternatively, base 26 and wall 28 can be formed as a single piece. Base 26 preferably includes a recess 32 for receiving the bottom of bag B.

Referring to FIGS. 1, 2 and 4 to 6, skirt 30 includes a guide and retaining member 34. As seen in FIGS. 4 to 6, guide and retaining member 34 includes a cylindrical and inclined passageway 36. A longitudinal axis passing through the center of passageway 36 forms an acute angle with a vertical plane and or axis passing though the center of base 26 and the center of bag B. Passageway 36 can be sized relative to dip tube 6, such that dip tube 6 can be held in place (see FIG. 5) by guide and retaining member 34 when no force is applied to dip tube 6 and when a force is applied to dip tube 6, dip tube 6 can move through passageway 36 to an operating position shown in FIG. 6. Referring to FIGS. 4 to 6, lower portion 38 of guide and retaining member 34 is spaced from downwardly extending lip 40 of skirt 30 such that upper portion of wall 28 can extend into the spaced formed between downwardly extending lip 40 of skirt 30 and lower portion 38. However, as previously explained skirt 30 including member 34 and wall 28 can be formed as a single piece.

Figure 1:
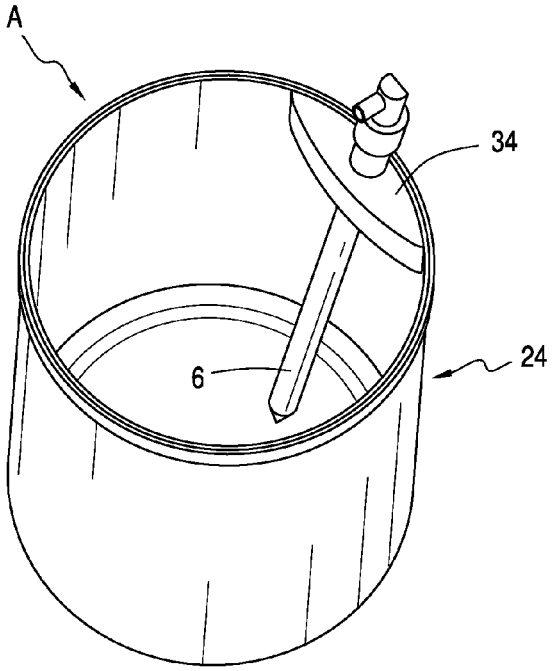
FIG. 1 is a perspective view of an apparatus for storing and dispensing liquid from a liquid retaining bag formed in accordance with a preferred embodiment of the present invention where the liquid retaining bag has been removed from the storage container.
Figure 3:
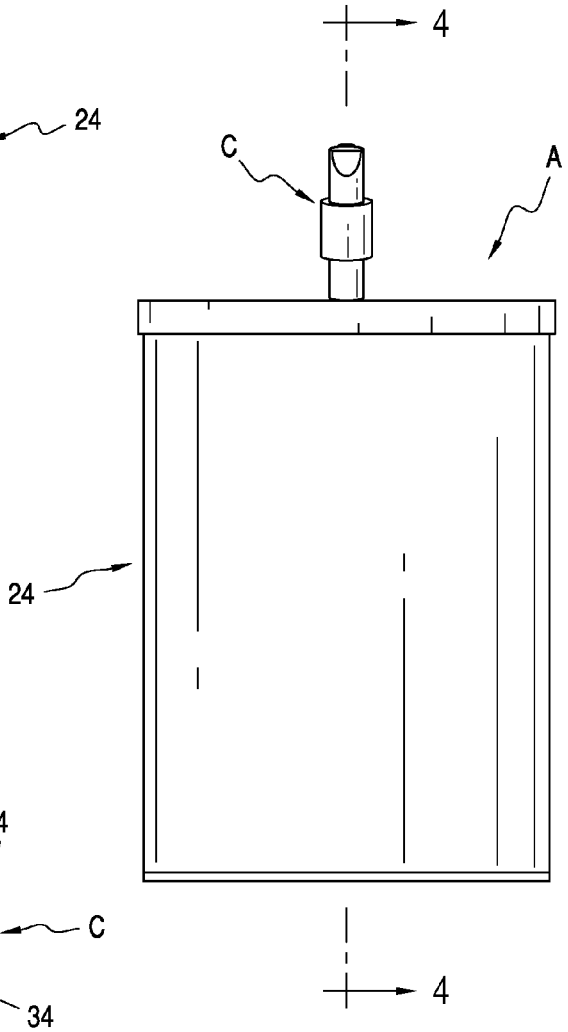
FIG. 3 is an elevational view of the apparatus for storing and dispensing liquid from a liquid retaining bag depicted in FIG. 1.
Figure 2:
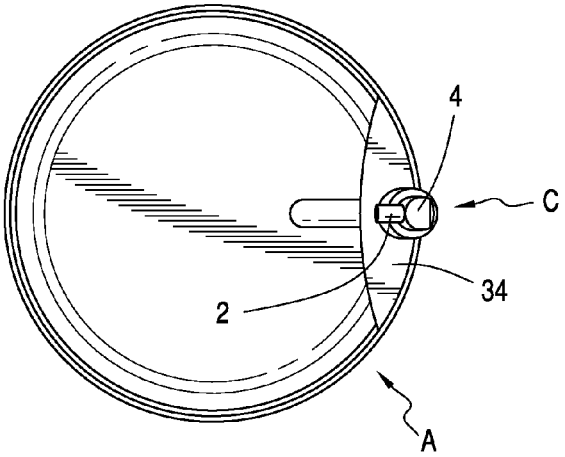
FIG. 2 is a plan view of the apparatus for storing and dispensing liquid from a liquid retaining bag depicted in FIG. 1.

Referring to FIGS. 1 and 2, guide and retaining member 34 occupies a very small portion of the area of the upper opening of storage container 24. This allows the liquid retaining bag B to be readily removed from storage container 24 and replaced with a new and fully filled liquid retaining bag B without removing skirt 30. Further, as seen in FIG. 5, the liquid transport assembly C can be held in a raised position to allow for removal and replacement of the liquid retaining bag B. As seen in FIG. 6, guide and retaining member 34 guide dip tube 6 such that spike 14 punctures bag B adjacent a sidewall 50 of bag B removed from a center portion of bag B.

It should be noted that the configuration of storage container 24 including but not limited to the number of walls can be readily varied as desired.

FIG. 8

Figure 8:
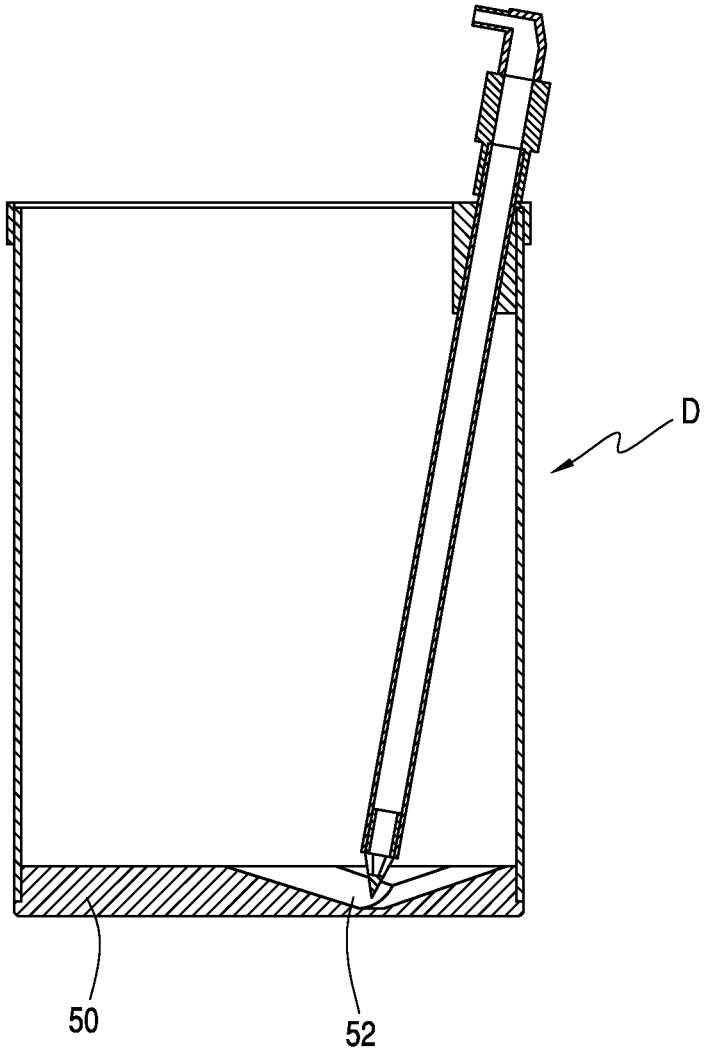
FIG. 8 is a cross-sectional view of an alternative apparatus for storing and dispensing liquid from a liquid retaining bag.

Referring to FIG. 8, an alternative form of storage and liquid dispensing unit D is illustrated in one of many possible configurations. Storage and liquid dispensing unit D is similar to liquid storage and liquid dispensing unit A and, therefore, only the differences will be described hereinafter. Specifically, base 50 of storage and liquid dispensing unit D includes a well-like depression 52 configured to minimize the residual water in the liquid retaining bag.

While this invention has been described as having a preferred design, it is to be understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

We claim:

1. An apparatus for storing and dispensing liquid from a liquid retaining bag, said apparatus comprising:

(a) a storage container for storing a liquid retaining bag, said storage container including a base, an upper opening and at least one sidewall connected to and extending upwardly from said base and defining a hollow cavity, said hollow cavity being sized to receive the liquid retaining bag;

(b) a liquid transport conduit for transporting liquid from the liquid retaining bag to a dispensing location;

(c) a guide and retaining member being connected to said storage container, said guide and retaining member having an insertion passageway, said guide and retaining member being configured to guide said liquid transport conduit from a first location to a second location wherein said liquid transport conduit is configured to be inserted into said insertion passageway of said guide and retaining member to travel from the first location to the second location, the second location is an operating position in which at least a portion of the liquid transport conduit extends into the liquid retaining bag and the first location is a location where no portion of the liquid transport conduit is within the liquid retaining bag, said guide and retaining member and said storage container being configured such that said liquid transport conduit can be positioned in a third location where the liquid retaining bag can be removed from said storage container through said upper opening while at least a portion of said liquid transport conduit is disposed below an uppermost surface of said at least one sidewall of said liquid storage container and at least a portion of said liquid transport conduit is connected to said guide and retaining member, the third location being between the first location and the second location and wherein said guide and retaining member is in a first position when said liquid transport conduit is moved from the first location to the second location and said guide and retaining member is in the first position when said liquid transport conduit is moved from the second location to the third location.

2. The apparatus of claim 1, wherein:

(a) the first location is a location positioned above the liquid retaining bag when the liquid retaining bag is stored in the storage container and said guide and retaining member is fixed to said at least one sidewall such that said guide and retaining member cannot move relative to said at least one sidewall.

3. The apparatus of claim 1, wherein:

(a) said guide and retaining member includes an arcuate outer surface and an inner surface, said arcuate outer surface includes a first end and a second end and said arcuate outer surface is in direct contact with an upper portion of said at least one sidewall along its entire length and said inner surface is disposed inwardly of said at least one sidewall.

4. The apparatus of claim 3, wherein:

(a) said insertion passageway forms an acute angle with a vertical axis passing through said storage container and an upper portion of said liquid transport conduit is disposed closer to said at least one sidewall than a lower end of said liquid transport conduit when said liquid transport conduit is in the second location.

5. The apparatus of claim 4, wherein:

(a) an uppermost portion of said hollow cavity has a first open area, the first open area extends in a horizontal plane, said guide and retaining member being connected to said storage container such that said guide and retaining member occupies only a minor portion of the first open area.

6. The apparatus of claim 1, wherein:

(a) said liquid transport conduit includes a spike for puncturing the liquid retaining bag, said spike includes at least one opening for permitting liquid from the liquid retaining bag to enter the liquid transport conduit.

7. The apparatus of claim 1, wherein:

(a) said guide and retaining member has a lowermost surface disposed above and spaced from the liquid retaining bag when no liquid has been dispensed from the liquid retaining bag.

8. The apparatus of claim 1, further including:

(a) a bottom loaded water cooler for housing said storage container in a lower portion of said bottom loaded water cooler, said lower portion is positioned below a dispensing location of the bottom loaded water cooler.

9. An apparatus for storing and dispensing liquid from a liquid retaining bag, said apparatus comprising:

(a) a storage container for storing a liquid retaining bag, said storage container including a housing for housing the liquid retaining bag, said housing having an upper opening through which the liquid retaining bag can be removed from said housing;

(b) a liquid transport conduit for transporting liquid from the liquid retaining bag to a dispensing location;

(c) a guide and retaining member being connected to an upper portion of said storage container, said guide and retaining member being configured to guide said liquid transport conduit from a first location to a second location while said guide and retaining member is connected to an upper portion of said storage container, wherein the second location is an operating position in which at least a portion of the liquid transport conduit extends into the liquid retaining bag and the first location is a location where no portion of the liquid transport conduit is within the liquid retaining bag, wherein in the second location said liquid transport conduit is oriented at an acute angle to a vertical axis passing through the liquid retaining bag; and, (d) said guide and retaining member and said storage container being configured such that said liquid transport conduit can be moved from the second location to a third location where the liquid retaining bag can be removed from said storage container through said upper opening while at least a portion of said liquid transport conduit is connected to said guide and retaining member without altering orientation of said guide and retaining member relative to said storage container when said liquid transport conduit is moved from the second location to the third location.

10. The apparatus of claim 9, wherein:

(a) said storage container has a circular cross-section.

11. The apparatus of claim 10, wherein:

(a) said liquid transport conduit has a length greater than a height of said storage container.

12. The apparatus of claim 11, wherein:

(a) said guide and retaining member is fixed to the upper portion of said storage container such that said guide and retaining member cannot move relative to said storage container.

13. The apparatus of claim 9, wherein:

(a) the first location is located above said liquid retaining bag.

14. The apparatus of claim 13, further including:

(a) a bottom loaded water cooler for housing said storage container in a lower portion of said bottom loaded water cooler, said lower portion is positioned below a dispensing location of said bottom loaded water cooler.

15. An apparatus for storing and dispensing liquid from a liquid retaining bag, said apparatus comprising:

(a) a storage container for storing a liquid retaining bag, said storage container including a base, at least one sidewall connected to and extending upwardly from said base and a skirt seated on said at least one sidewall, said storage container being an open top storage container having an uppermost opening which remains open and through which the liquid retaining bag can be removed from said open top storage container;

(b) a liquid transport conduit for transporting liquid from the liquid retaining bag to a dispensing location;

(c) said skirt including a guide and retaining member, said guide and retaining member having an insertion passageway oriented in a first orientation relative to said at least one sidewall, said guide and retaining member being configured to guide said liquid transport conduit from a first location to a second location while said insertion passageway is oriented in said first orientation, wherein said liquid transport conduit is configured to be inserted into said insertion passageway of said guide and retaining member to travel from the first location to the second location, the second location is an operating position in which at least a portion of the liquid transport conduit extends into the liquid retaining bag and the first location is a location where no portion of the liquid transport conduit is within the liquid retaining bag, said guide and retaining member and said storage container being configured such that said liquid transport conduit can be positioned in a third location where the liquid retaining bag can be removed from said storage container through said upper opening while at least a portion of said liquid transport conduit is disposed in said insertion passageway and said insertion passageway is in said first orientation.

16. The apparatus of claim 15, wherein:

(a) the first location is a location above the liquid retaining bag when the liquid retaining bag is housed in the storage container.

17. The apparatus of claim 16, wherein:

(a) said guide and retaining member has a lowermost surface disposed above and spaced from the liquid retaining bag when no liquid has been dispensed from the liquid retaining bag.

18. The apparatus of claim 17, wherein:

(a) said insertion passageway is inclined at an acute angle to a vertical axis passing through said storage container.

19. The apparatus of claim 15, wherein:

(a) said skirt has a first opening through which the liquid retaining bag can be removed from said storage container when said skirt is seated on said at least one sidewall.

20. The apparatus of claim 19, wherein:

(a) said skirt has a vertically extending annular wall, said vertically extending annular wall extends along and contacts an outer vertically extending surface of said at least one sidewall.

* * * * *